US005695443A

United States Patent [19]

Brent et al.

[11] Patent Number: 5,695,443

[45] Date of Patent: Dec. 9, 1997

[54] HIGH ENERGY RADIATION EMISSION SHELTER AND METHOD OF MAKING THE SAME

[76] Inventors: Robert W. Brent, 2106 St. Andrews Rd., Jeffersonville, Ind. 47130; David L. Zeller, 3711 Palmer Park Rd., Crestwood, Ky. 40014

[21] Appl. No.: 686,531

[22] Filed: Jul. 26, 1996

[51] Int. Cl.[6] ..... A62D 3/00

[52] U.S. Cl. ..... 588/249; 405/128; 252/626; 252/627; 252/628; 252/629; 52/562

[58] Field of Search ..... 52/561, 562; 405/128; 588/247, 249, 258; 252/626–633

[56] References Cited

U.S. PATENT DOCUMENTS

| | | | |
|---|---|---|---|
| 3,929,568 | 12/1975 | Schabert et al. . | |
| 4,081,323 | 3/1978 | Gans, Jr. et al. . | |
| 4,175,005 | 11/1979 | Harstead . | |
| 4,507,899 | 4/1985 | Janitzky . | |
| 4,878,324 | 11/1989 | Rissel . | |
| 4,950,426 | 8/1990 | Markowitz et al. | 405/128 X |
| 5,215,408 | 6/1993 | Zimmerman | 405/128 X |
| 5,304,705 | 4/1994 | Himmelheber | 405/128 X |
| 5,320,455 | 6/1994 | Mattox . | |
| 5,391,019 | 2/1995 | Morgan | 588/249 X |
| 5,436,385 | 7/1995 | Kaden | 405/128 X |
| 5,498,825 | 3/1996 | Stahl | 405/128 X |
| 5,511,908 | 4/1996 | Van Valkenburgh et al. | 405/128 |

OTHER PUBLICATIONS

Symons Brochure "Steel–Ply® Forming System Application Guide" 1993.

*Primary Examiner*—Carl D. Friedman
*Assistant Examiner*—W. Glenn Edwards
*Attorney, Agent, or Firm*—Wheat, Camoriano, Smith & Beres, PLC

[57] ABSTRACT

A temporary shelter for housing and shielding a high energy radiation source used to irradiate objects and includes a hot cell for enclosing the source. An outer perimeter structure, including at least one wall, substantially encloses the hot cell and together with the cell forms an interior space positioned between the cell and outer wall. The interior space is filled with sand, covering the cell except for a front opening into the cell. The walls of the cell and outer structure are comprised of a rail and panel structure tied together with wire form ties to provide internal structural integrity against the weight of the sand. The sand and appropriately located other high energy attenuating components attenuate the energy emissions to a value less than the MPD Distance for the particular high energy radiation emitting source immediately to the exterior of the shelter.

14 Claims, 8 Drawing Sheets

HIGH ENERGY RADIATION EMISSION SHELTER AND METHOD OF MAKING THE SAME

BACKGROUND OF THE INVENTION

The present invention pertains to a structure and method of fabricating shielding structures that house high energy emitting instrumentation and, more particularly, shielding structures for housing high energy emitting that are easily erected and removed and/or replaced.

Existing shielding structures that are presently used by hospitals and the like to house, for example, gamma radiation treatment centers for cancer patients, are permanent structures typically made with materials that are not easily installed or removed. As hospitals and other high energy using facilities expand or require renovation or the instrumentation itself changes due to new technology innovations requiring changes in work space needs, the significant obstacle to the construction is the original shielding structure for housing the high energy emission instrumentation. The materials used for the shielding structure cannot easily be torn down and removed and the expense and time for relocating or changing the shielding structure may reach extraordinary levels.

It is therefore a paramount object of the present invention to provide for a shielding structure for housing high energy radiation emitting sources and method of fabricating the structure that is easily constructed and removed. It is still another important object of the present invention to provide for a shielding structure that is constructed of readily available materials permitting rapid erection and removal of the structure. These and other objects of the present invention will become readily apparent following a reading of the detailed description of the preferred embodiment taken with the various figures illustrating the invention.

SUMMARY OF THE INVENTION

The present invention pertains to a temporary shelter for housing and shielding a high energy radiation source used to irradiate objects and having a front side for accessing the radiation source. The shelter includes a hot cell for enclosing the source with the cell having at least one first wall, a front opening, and a roof capable of supporting a predetermined quantity of sand. An outer perimeter structure, including at least one wall, extends around the cell and forms an interior space positioned between the first and second walls. The outer perimeter wall is higher than the cell first wall.

An energy attenuating structure extends across the front opening and abuts the outer perimeter structure. At least one portion of the energy attenuating structure is removable thereby providing access to the cell and the high energy source. The first cell wall and outer perimeter wall both include a frame structure of vertically and horizontally disposed rails and a plurality of abutting panels horizontally positioned against an interior side formed by said rails. The first cell wall and outer perimeter wall further being connected by support wire form ties extending horizontally within the interior space to provide structural integrity against pressure being exerted outwardly on the outer perimeter wall and inwardly on the first cell wall. A quantity of sand fills the interior space and covers the roof of the cell. The outer perimeter wall is spaced from the first wall a distance sufficient for said sand to attenuate the measurable energy level at a majority of points immediately exterior to said outer perimeter wall to less than the maximum acceptable dosage level for the high energy source. Similarly, the energy attenuating structure attenuates the measurable energy emanating across the front of the shelter and at all other points along said the perimeter wall to less than the maximum level at all points immediately exterior to the front and the perimeter wall.

DETAILED DESCRIPTION OF THE PREFERRED EMBODIMENT

Figure 1:
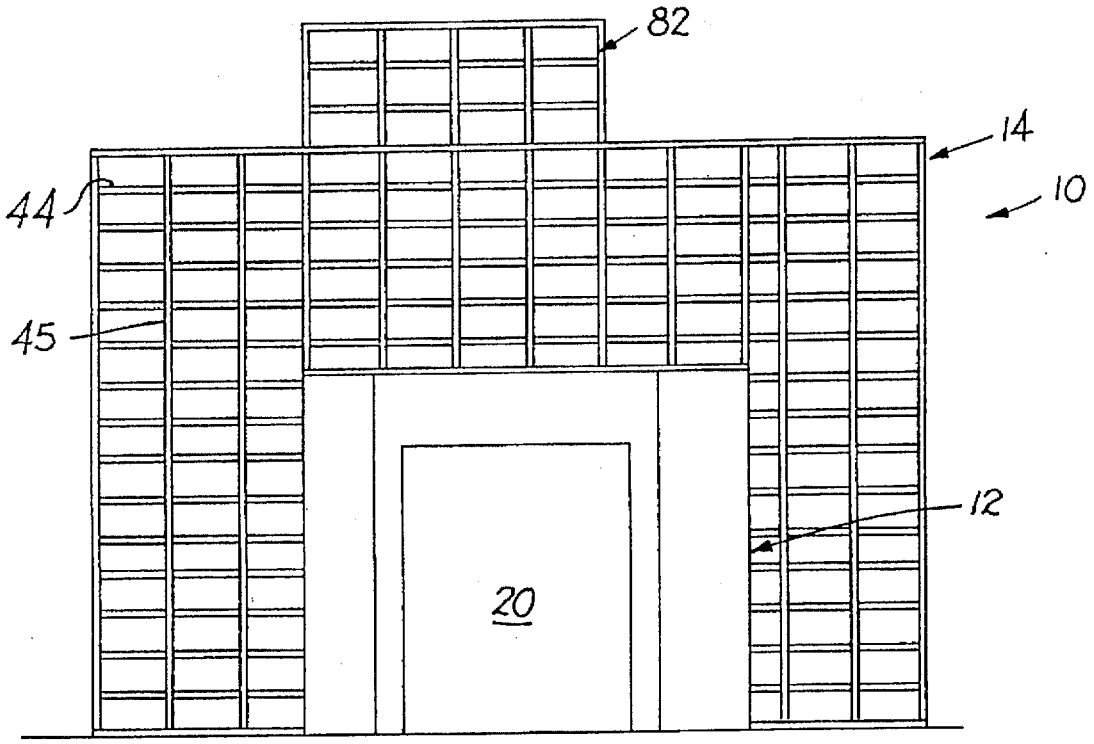
FIG. 1 is a front elevation of a portion of a shielding structure constructed in accordance with the present invention showing the grid-like frame and open entrance into the hot cell.

Reference is now made to FIGS. 1–6 for a discussion of the preferred embodiment of the present invention. The temporary shelter is shown generally by the character numeral 10 and is comprised of two major components, a "hot" cell 12 and an exterior structure 14. The cell 12 houses a high energy source 16 such as, for example, a gamma knife radiation instrument used in neural surgery or a radioactive radiation source for cancer radiation treatment. For purposes of this description, the term "radiation" means either a high energy microwave or high energy particles released by the source, the unprotected prolonged exposure to which could physically damage personnel.

Sand 18 or a similar material fills the interior of the structure 14 and covers the cell 12 except for a front opening 20 into the cell 12. A barrier 22 is positioned across the opening 18 and provides access to the interior of the cell 12. In the top view of FIG. 2, barrier 22 is illustrated as having passageways 24 (only one being shown) through which a mechanical arm (not shown) may extend to move the source and operate other controls within the cell 12.

Figure 2:
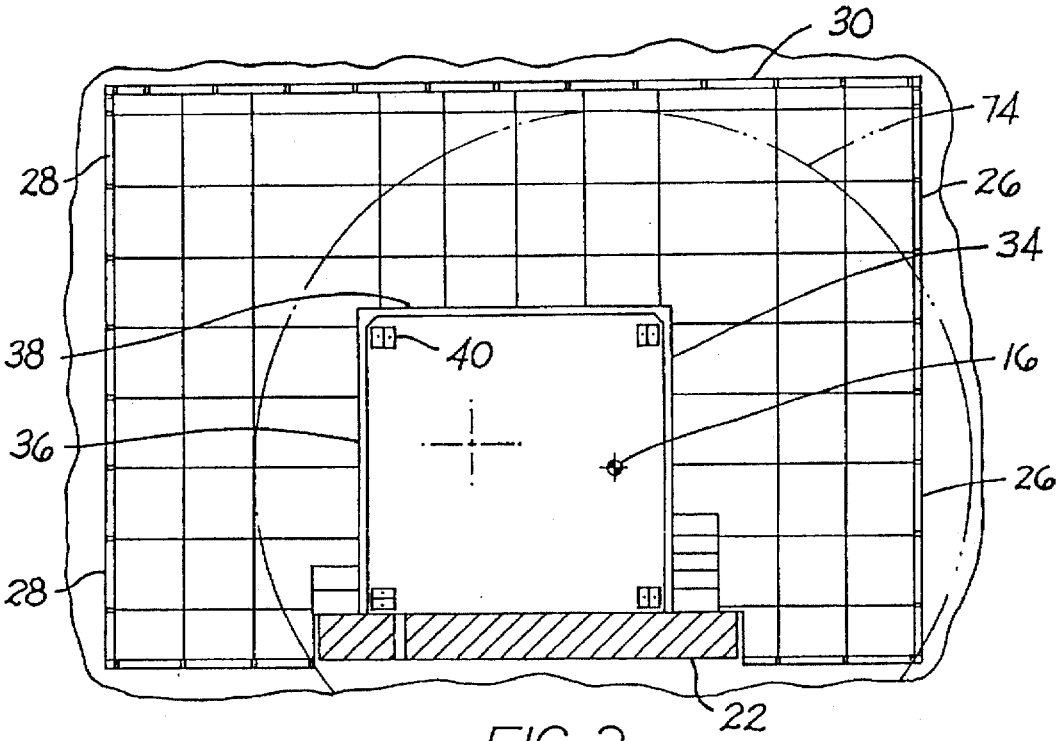
FIG. 2 is a top sectional view of the shielding structure showing a pass through type of barrier over the entrance to the hot cell.

The exterior structure 14 has, as best seen in FIG. 2, a pair of side walls 26 and 28, a rear wall 30 and a front wall 32. Front wall 32 abuts the barrier 22 on both sides and extends over the top of opening 20 (as illustrated in FIG. 1). Cell 12 has a pair of side walls 34, 36, a rear wall 38, and support members 40 positioned in each corner of cell 12 supporting a roof 42.

Figure 1B:
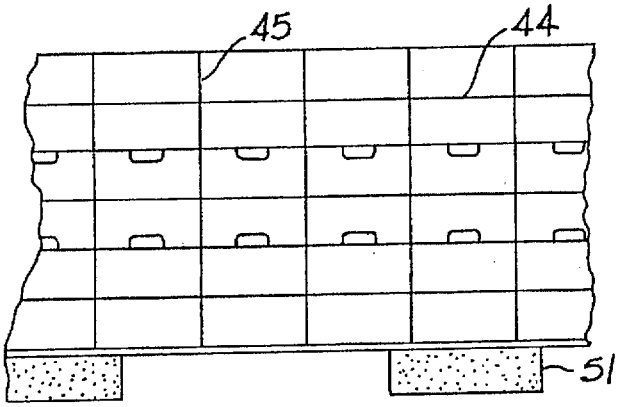
FIG. 1*b* is a partial front view of a wall fabricated from a plurality of panels shown in FIG. 1*a;*
Figure 1C:
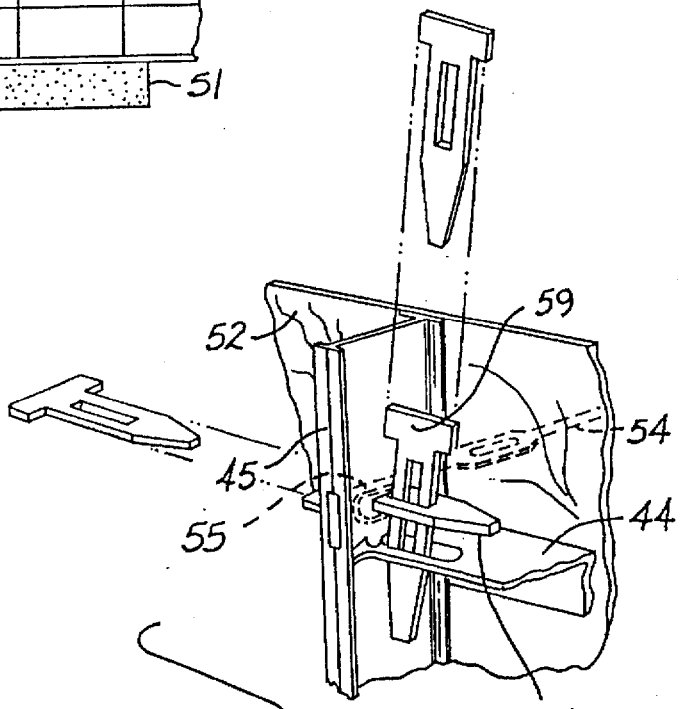
FIG. 1*c* is an exploded perspective of the connection between rails and wire form ties tieing walls of the shelter together to support the pressure exerted by the sand against the walls.
Figure 1A:
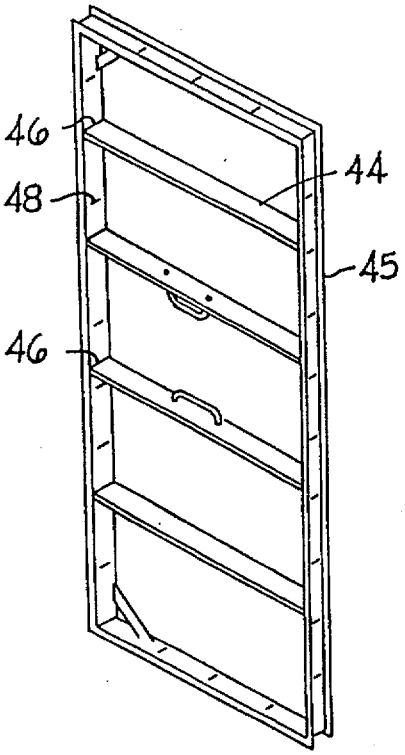
FIG. 1*a* is a front perspective illustration of a single rail panel used to form the walls of the shielding structure.
Figure 5:
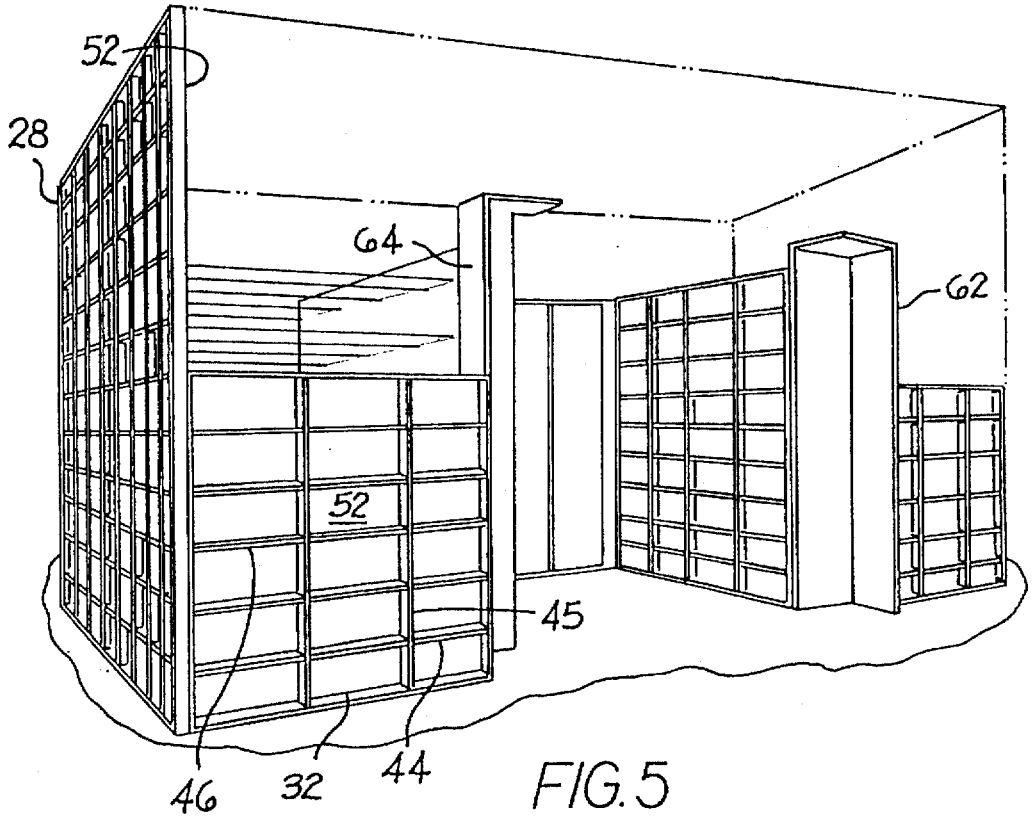
FIG. 5 is a front perspective of a partially completed shielding structure.

The walls of the cell 12 and perimeter structure 14 are constructed of light and easily positioned and moved materials. Preferably the framework of the walls are a plurality of metal horizontal rails 44 and vertical rails 45 forming a grid-like pattern, as illustrated in FIGS. 1 and 5. The horizontally positioned rails 44 are secured at the points 46 along the vertical lengths 45. An example of a preferred rail and panel system can be purchased from the Symons Corporation as the Steel Ply System, a registered trademark of the Symons Corporation. It should be understood, however, that other rail and panel systems are commercially available and can be used in many situations. For detailed information of the fabrication of such a rail and panel system, reference may be made to the *Steel-Ply Forming System Application Guide* published by and obtainable from the Symons Corporation. Illustrations of the preferred rail and panel construction are seen in FIGS. 1*a*, 1*b* and 1*c*. Rails 44 and 45 are fabricated from steel. Vertical rail lengths 45 advantageously have multiple slots 48 along the vertical lengths to which the ends of the horizontal lengths may be secured. The vertical lengths of rails 45 come in various sizes, ranging from 3 feet to 8 feet in length with 6 inch spacing between slots for the ends of the horizontal lengths. The horizontal lengths 44 are typically 12 inches or one foot long although other lengths are readily available. The frame work of rails 44 and 45 may have a footing 51 of concrete as depicted in FIG. 1*b* and are secured to the footing by fasteners such as concrete nails or the like. In most instances, however, it is not necessary to have a footing as the individual frame can be positioned directly on smooth sand or unattached steel plates.

Once the frame work of rails have been assembled into a desired configuration, interior sides of the rails forming the walls of the external structure 14 and the exterior walls of the cell 12 are lined with abutting panels 52, preferably plyboard, as best illustrated in FIG. 5 and 5*a*. The panels 52 are secured to the frame typically by screws through flanges (not shown) of the vertical rails 44.

Because the walls are light and need to withstand the pressure of sand, it is important that the walls be provided additional strength. This is accomplished by stringing cable 54, preferably in several horizontal layers, across both the width and length of the interior defined by the outer perimeter structure 14 as best seen in the top sectional view of FIG. 2 and the perspective of FIG. 6. As illustrated specifically in FIG. 2, some of the wire form ties 54 are attached between the interior wall surface of the structure 14 and the exterior surface of cell 12. The wire form ties 54 may be attached at the ends thereof to the interior surface of the walls in the manner shown in FIG. 1*c* with the hook ends 55 thereof around horizontally mounted wedges 57 extending through a vertical rail 44. Wedges 57 are further secured in place by vertical wedges 59. The wire form ties 54 should have a load capacity sufficient to withstand the outward pressure of the sand when placed within the interior defined by perimeter structure 14. A load safety factor for most constructions of 2,250 pounds has been found sufficient.

Figure 4A:
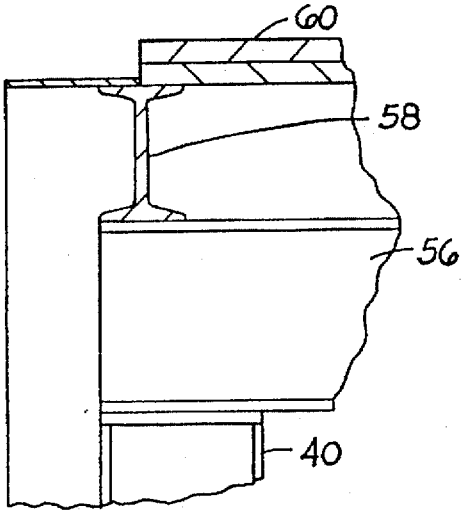
FIG. 4*a* is an enlargement of the hot cell roof support structure taken from FIG. 4.

The upright members 40 of cell 12 are preferably steel T-section upright beams positioned in each interior corner of the cell 12. As illustrated in FIG. 4*a*, horizontally positioned T-shaped steel cross beams 56 are supported at each end by and welded or otherwise fixed to adjacent upright beams 40 with a plurality of spaced, parallel T-shaped steel roof supports 58 being supported by and similarly fixed to cross beams 56. The roof 42 extends across supports 58 and is comprised of high energy radiation impeding material such as, for example, a plurality of abutting steel plates 60. For hot cells of smaller dimensions, it may not be necessary to use spaced roof supports 58 for roof 42 since the material comprising the roof can be laid directly on and across the cross beams 56.

The entrance to cell is depicted in the top sectional view of FIG. 2 as flanked by two forms 62 and 64 that serve as the abutting sides to barrier member 22 positioned across the entrance to the cell 12. The shape of forms 62 and 64 are shown in the perspective of FIG. 5. A pair of stacks of dry laid, solid concrete blocks 66, 68 are situated adjacent the walls 34, 36 and forms 62 and 64 for a reason to be discussed below. Cell 12 may further be provided with a smaller structure such as housing 70 extending out through roof 22 to be used, for example, to enclose mechanisms for moving source 16 about within the interior of the cell. Housing 70 is mounted on the underlying roof supports 58 of cell 12 and has vertical uprights 70*a* supporting cross members 70*b* and abutting steel plates as a roof 72 to housing 68.

Figure 6:
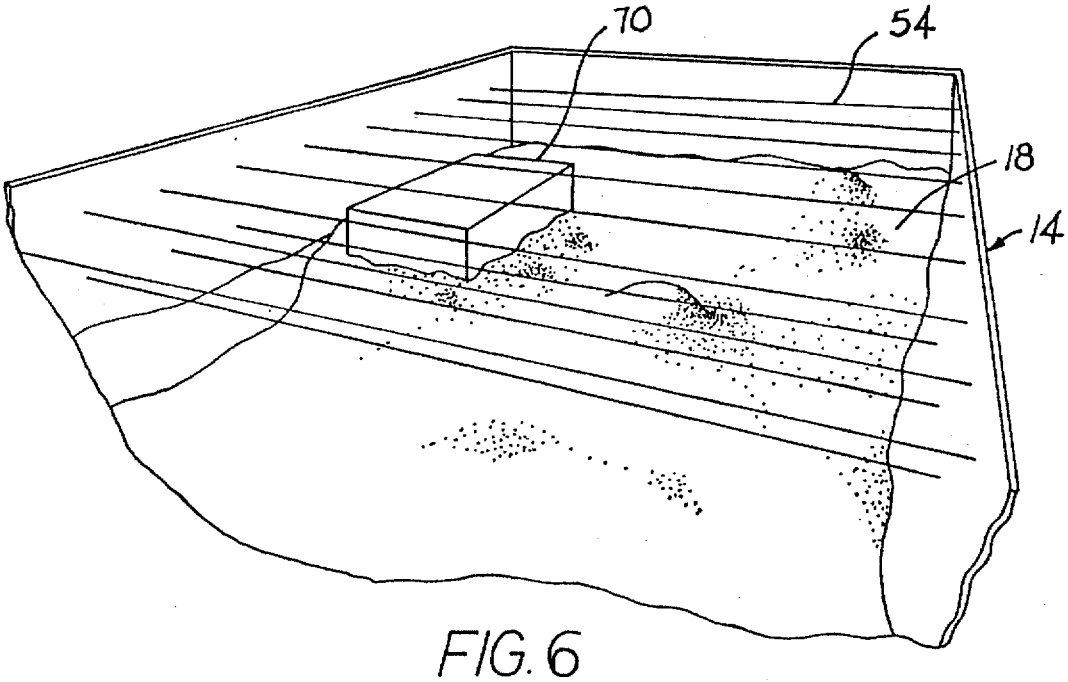
FIG. 6 is a top perspective of the shielding structure partially filled with sand showing the top of a housing extension of the hot cell and a pair of levels of horizontal wire form ties exposed.

Once the shelter has been completed then the sand 18 can be dumped into the interior volume of the external perimeter structure 14. The perspective of FIG. 6 illustrates the interior volume as partially filled with sand so that the top of housing 70 and two horizontal levels of wire form ties 54 are still exposed. When the interior volume is completely filled, the level of the sand approaches the top of the walls of structure 14, completely covering the top of cell 12 including housing 70.

The internal dimensions of the cell are strictly a function of the interior working space needed. Where medical or scientific personnel are required to physically be in the interior space preparatory to operation of the high energy radiation source, a larger space will be required than for robotic operations. The overall dimensions and composition of the shelter itself is a function of the Maximum Permissible Dose Equivalent ("MPD") allowed. The National Council on Radiation Protection and Measurements defines the MPD as the maximum dose equivalent that persons shall be allowed to receive in a stated period of time. Typically, the MPD is an average weekly dosage that varies depending upon the type of radiation and the intensity of thereof. For example, in NRCP Report No. 49 discussed below, it is recommended that that the average weekly exposure value of radiation workers be less than about 100 mR and for other workers less than about 10 mR. Thus, for a given radiation emitting source of known emitting intensity where the frequency of operation and duration of each operating time period is known, calculations can be started for the type of construction necessary to attenuate the radiation from the source to such a degree that the values of radiation emissions exterior to the construction will not exceed the lower value of MPD for personnel would adjacent to the structure. The first step is to calculate the distance from the high energy radiation source at which the MPD occurs using sand as the medium through which the radiation must travel. For purposes of this description, such distance will termed the "MPD Distance". Once the MPD Distance is calculated for the high energy radiation source, the "isocenter" or the appropriate position of the radiation source (or positions where movable sources are involved) can be determined along with the composition and dimensions of the shelter. It should be understood that calculations of the MPD Distance can be complex since the radiation source, for many practical reasons, may be located to one side of the cell and/or raised or lowered in the cell. Additionally, the source may be directional such that greater radiation intensity will occur in one direction than in other directions where scattering is likely to occur. It also may be necessary to locate the shelter near other occupied structures requiring the minimization of the dimensions of the shelter in the direction of these occupied structures.

Various reports of the National Council on Radiation Protection and Measurement provide all of the information needed to make the calculations for the MPD Distance. For example, the aforementioned NCRP Report No. 49 provides guidelines for shielding design and evaluation for medical use of X rays and gamma rays of energies up to 10 MeV. Report No. 51 provides guidelines for particle accelerator facilities from 0.1 to 100 MeV particles. NCRP Report No. 79 provides guidelines for protection against neutron contamination from medical electron accelerators. Each report provides graphs for various materials to determine the thickness of shielding using that material so that the dosage workers and/or general public receive will not exceed the MPD for each category of individual. Graphs and tables are supplied for various materials at varying radiation energy levels and at various scattering angles to determine the attenuation of the emissions through the material. Knowing the focus angle of the source, one can then determined MPD Distance both in direct line of sight and other directions using the scattering angle information in the reports for a given material at a given frequency of source operation and duration in specified directions. Reference is made to these various reports readily available from the National Council on Radiation Protection and Measurement. These reports have sufficiently detailed information to permit those skilled in the art to make the appropriate calculations for determining to the centimeter the MPD Distances needed for various materials, direct and scattering angles for various energy emitting sources at various operating parameters.

Figure 3:
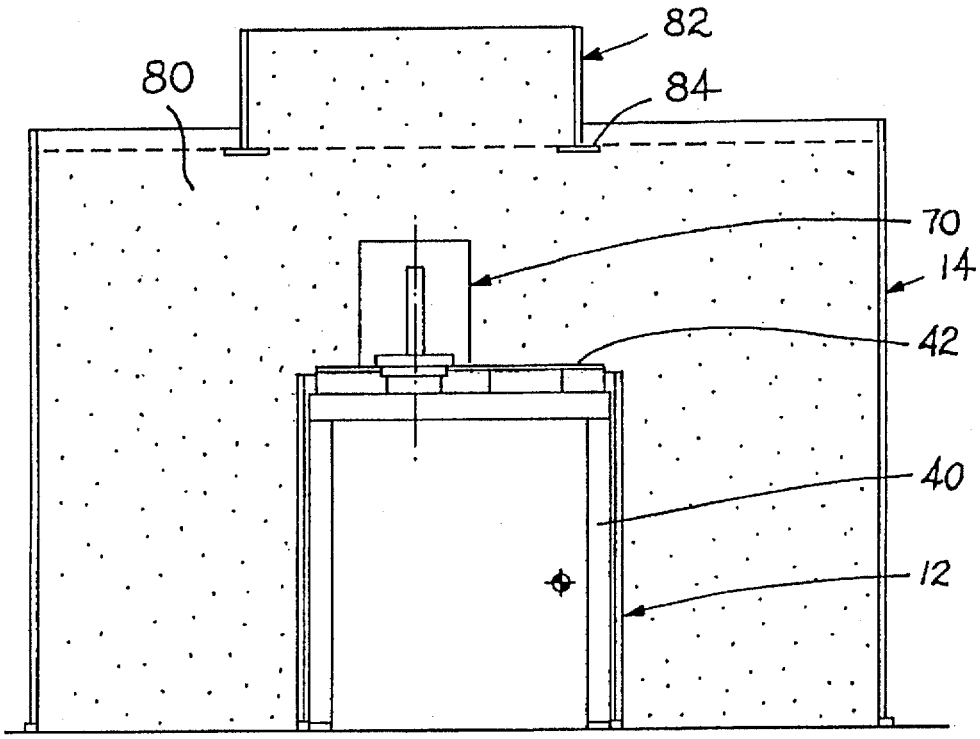
FIG. 3 is a front sectional view of the shielding structure showing the hot cell construction.

For the sake of simplicity and illustrative purposes only, a circle 74 (in dashed lines) representing a planar projection of a sphere using the source 16 as the center of the circle is depicted in FIGS. 2 and 3. The source 16, for clarity of discussion, is considered to be emitting radiation of the same type and intensity in all directions. Circle 74 portrays a distance equal to or greater than the MPD Distance from the source 16 (having a predetermined radiation intensity, specified frequency of activation and known time duration of each period of activation) for radiation traveling entirely through sand 18. The attenuating characteristics of air through the short radiation travel distance through the air within the cell and thin structures of the walls of the outer perimeter structure 14 and cell walls are considered negligible.

Figure 7B:
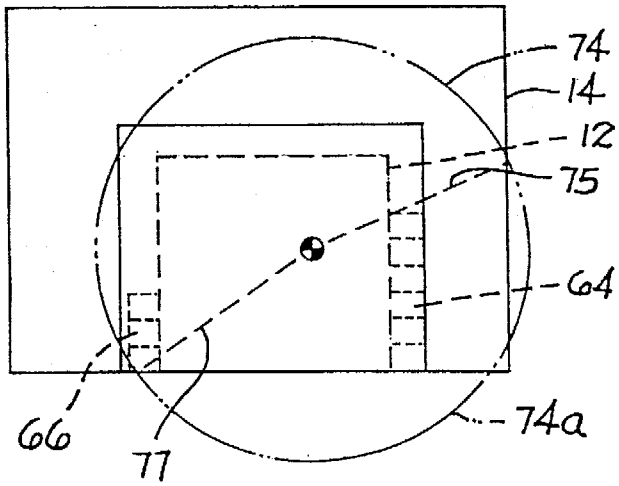
FIG. 7*b* is a side schematic of the external perimeter structure and cell of FIG. 7*a*, showing that a portion of the MPED circle lies outside of the external perimeter structure in this configuration also.
Figure 7A:
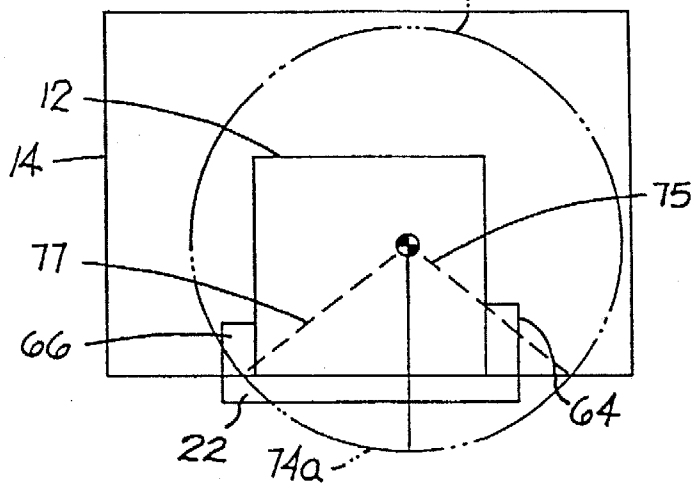
FIG. 7*a* is a top schematic of the external perimeter structure and cell housing the high energy radiation source, showing that a portion of the MPED circle lies outside of the external perimeter structure.

In FIG. 2, it may be seen that circle 74 is well within the perimeter defined by walls 34, 36 and 38 of the external perimeter structure 14 except in a certain region along wall 26, a portion of front wall 20 and the entrance opening 20 of cell 12. The denser, metal material of the barrier 22 impedes the radiation along the front of cell 12 so that, immediately to the exterior of barrier 22, the level of measureable radiation is lower than the MPD. The stacks of solid concrete blocks 66 and 68 are appropriately positioned adjacent the cell 12 in "line of sight" from the source to those points on the walls of the outer structure where the walls are closer to the source 16 than the MPD distance. The solid concrete blocks are denser than the sand and thus have greater high energy radiation attenuating characteristics than the sand. The positioning in the line of sight requires the radiation that would otherwise penetrate outside of wall 26 and front wall 20 to pass through the denser medium of the columns and be attenuated to acceptable measurable levels below the MPD immediately to the exterior of the outer perimeter 14 at the points in the line of sight. This effect is perhaps best illustrated by the schematics of FIG. 7*a* and 7*b* wherein an arc of the MPD Distance circle 74, represented by the character numeral 74*a*, extends beyond the perimeter of structure 14. The dashed lines 75 and 77, radiating out from the source 16 and subtending the arc 74*a*, are the line of sight lines that mark the boundaries of the points on the structure 14 lying inside the circle 74. As illustrated by FIGS. 7*a* and 7*b*, columns 64 and 66 along with barrier 22 extend through lines 75 and 77 and thus all line of sight lines lying between lines 75 and 77. As stated above, the circle 74 is a projection of a sphere whose surface is the locus of all points lying an MPD Distance from the source. The columns 64 and 66 and barrier 22, in fact, intersect all line of sight lines intersecting the walls of the perimeter structure and extend out through the opening defined in the front wall of the structure 14.

From the foregoing it can be appreciated that, while the outer perimeter structure is illustrated as a being rectangular in section to substantially encompass the idealized circle 74, shapes other than rectangular are likely to be used, including a single cylindrical, horizontally disposed wall or a spherical shape with an open top. Such shapes could provide the required geometries of the structure 14 described herein.

Figure 4:
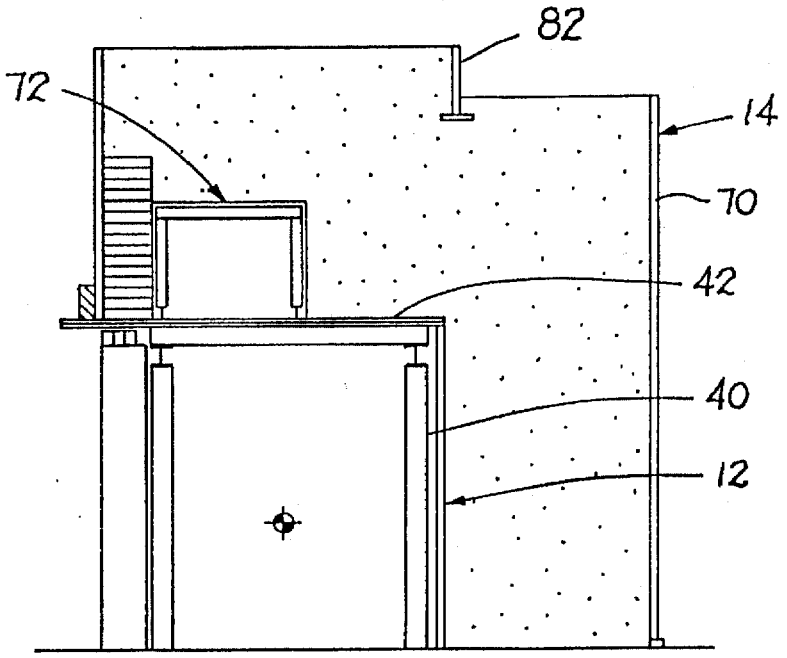
FIG. 4 is a side sectional view of the shielding structure showing the hot cell construction.

In the view afforded by FIG. 3, the MPD distance would extend above the top of the sand 18 in a region immediately adjacent immediately adjacent housing 70. This is due to the additional air space formed by housing 70 at the top of the cell, resulting in less attenuation of the radiation. This discontinuity is depicted by the arc of circle 76 subtended by dashed lines 78 and 80 (line of sight lines) extending from source 16 through the corners of housing 70. While it may be practical merely to "mound" the sand in this region to compensate for the discontinuity, it is preferable to erect a smaller frame and panel structure 82 to hold additional sand in the region, thus minimizing the detrimental effect of shifting of the mound that otherwise may occur. Reference is made to FIGS. 2, 3 and 4 specifically illustrating the additional smaller structure 82 using the sand 18 within the interior formed by structure 14 as the ground for footing 84. Except for the absence of wire form ties due to the smaller volume of sand and lesser outward pressure, the structure 82 may be identical in construction to structure 14.

Figure 8:
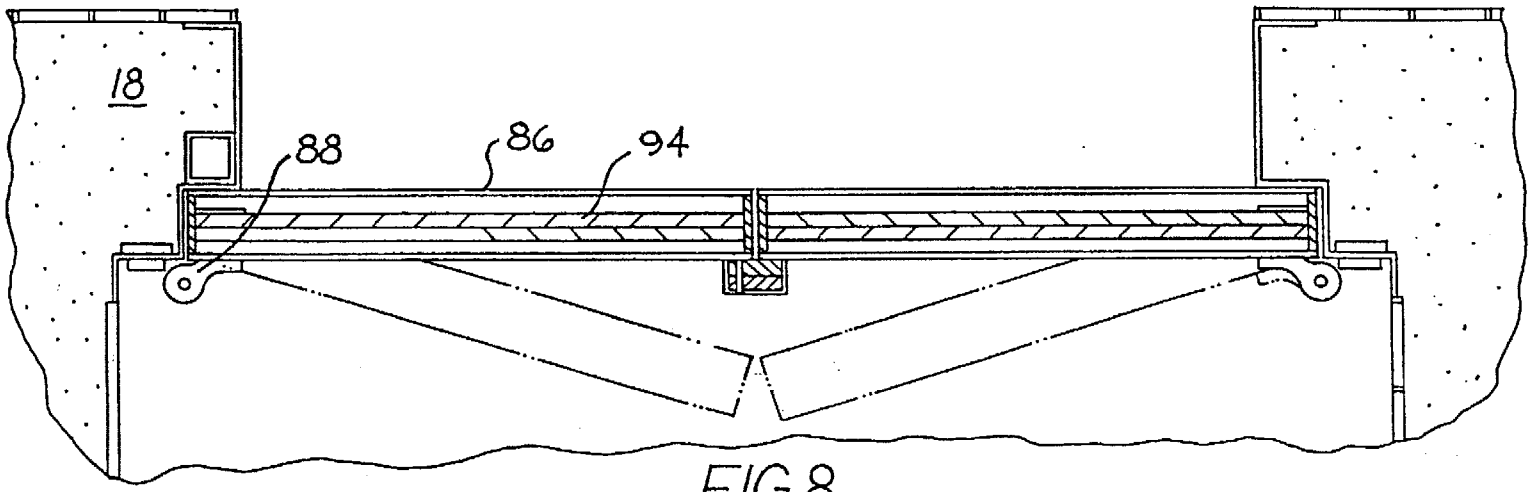
FIG. 8 is a top sectional view of a pair of swinging door serving as a removable barrier to the entrance to the hot cell.
Figure 9:
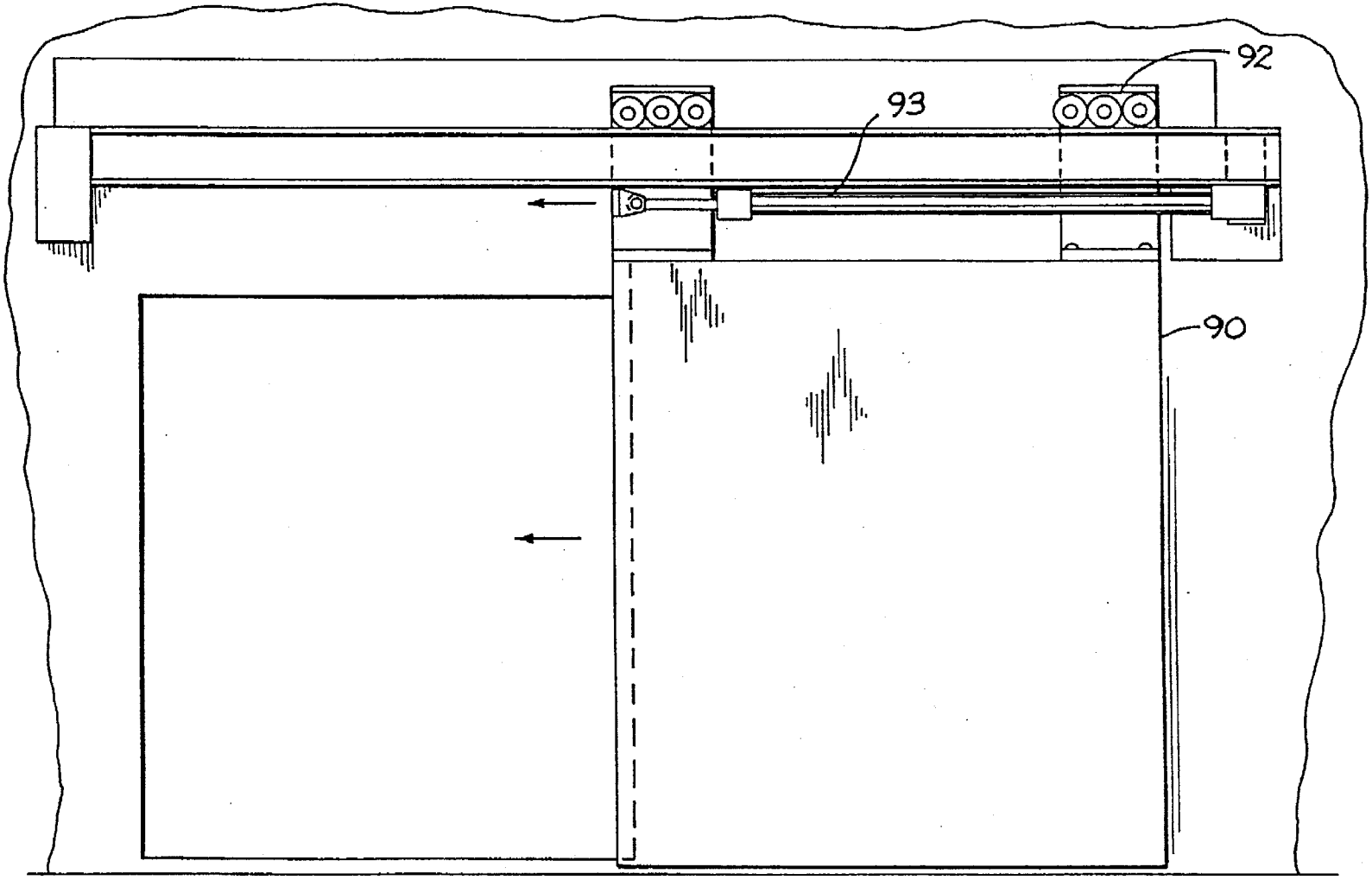
FIG. 9 is a top sectional view of a sliding door serving as a removable barrier to the entrance to the hot cell.

The barrier 22 can also take the form of swinging doors 86 pivoting on pivots 88 as shown in FIG. 8 or sliding doors 90 actuated by hydraulic cylinder 93 and riding on rollers 92 in FIG. 9. In either case, the composition of the doors 86 or 90 is typically a metal such as steel or, in the case of very high energy emissions, steel doors having a lead core 94.

Figure 10:
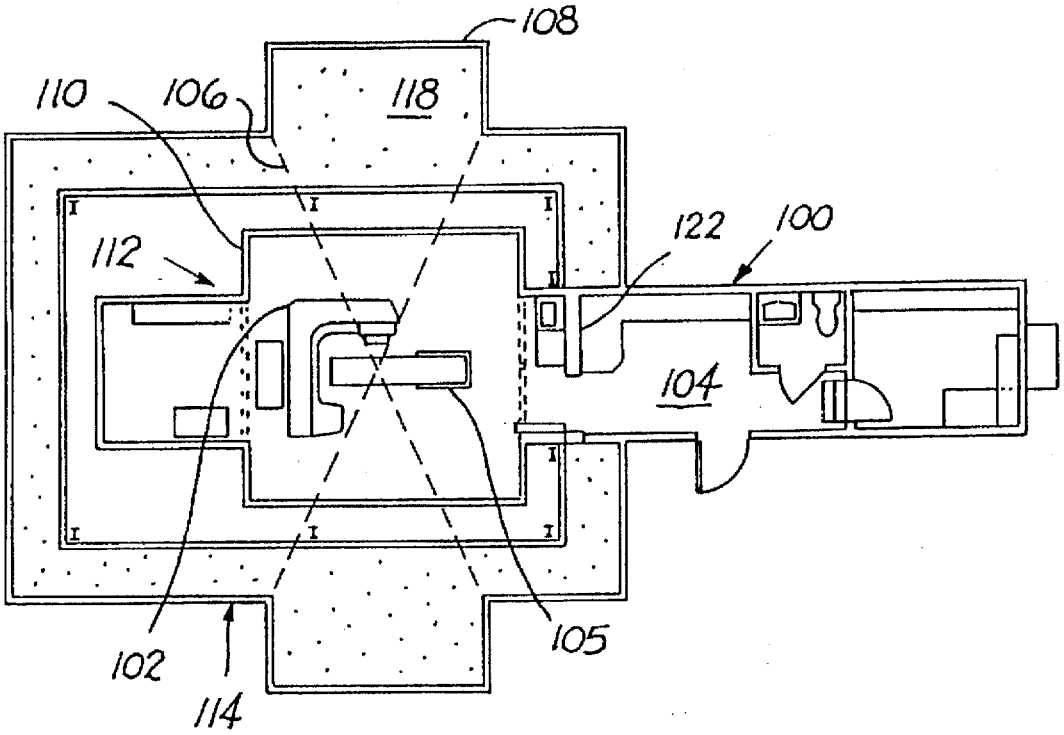
FIG. 10 is a top schematic view of an alternate embodiment of the present invention in which a mobile trailer forms part of the hot cell structure and carries the removable barrier to the entrance to the hot cell.
Figure 11:
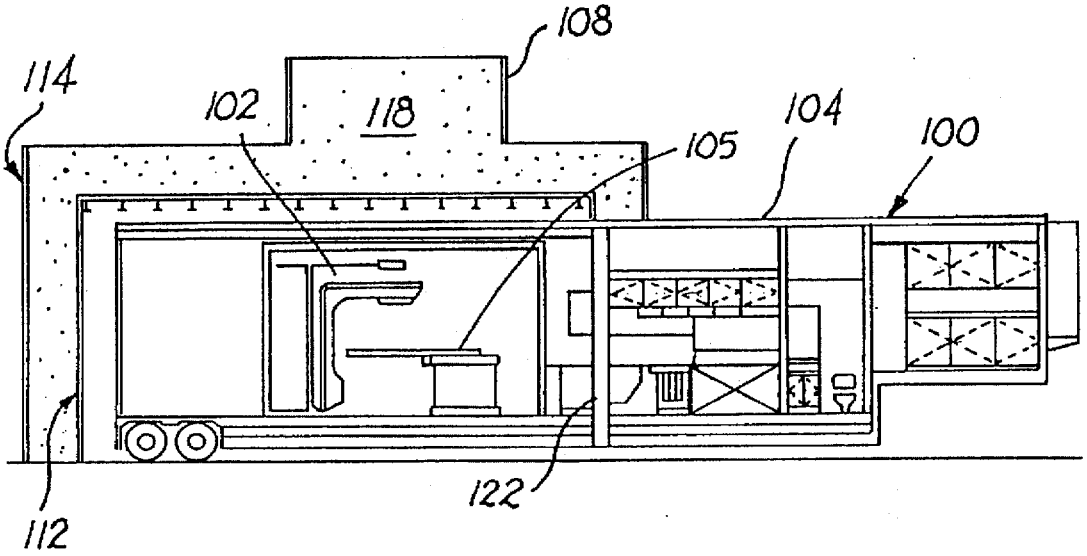
FIG. 11 is a side view of the embodiment of FIG. 9.

Another embodiment of the present invention is illustrated in FIGS. 10 and 11. A trailer 100 is shown as divided between a front portion 104 and a rear portion 105 with the rear portion 105 forming part of the hot cell 112. The rear portion 105 may contain, for example, high energy instrumentation 102 such as a radioactive cobalt treating instrument that focuses its emissions in a 360° conical pattern illustrated by focus lines 106. Outer perimeter structure 114 forms a perimeter about hot cell 112 and sand 118 covers the hot cell 112 including the rear portion 105 of the trailer 100. The front portion 104 may contain a preparation work area 104 and is divided from the rear portion by a swinging door barrier 122 having radiation attenuating characteristics such that the level of emissions immediately outside of the barrier 122, i.e., in portion 104 is no more than the MPD.

The clear benefit of this embodiment is that the instrumentation and work area can be rapidly installed into the hot cell and removed or replaced. The structure surrounding the trailer is made from readily available materials that itself can be easily removed and disposed.

To provide increased work space, the rear portion 105 may be provided with expandable sides 110. To ensure the proper attenuation of the focussed emissions in the conical pattern, the perimeter 114 is positioned so that additional sand 118 may be placed in the path of the emissions as shown by the added structure 108 to ensure the MPD level is met immediately to the exterior of the 114 at all points.

Figure 12:
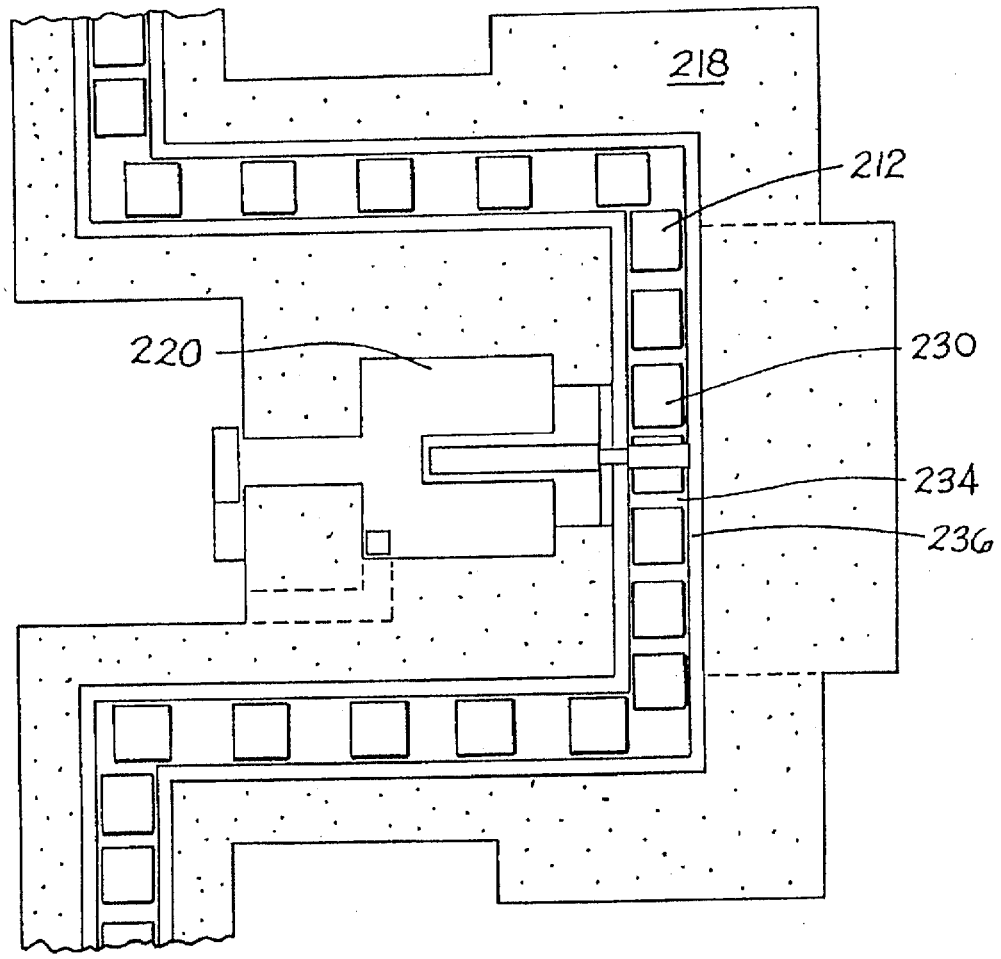
FIG. 12 is a top schematic view of still another embodiment of the present invention in which a serpentine conveyor is burrowed through the sand and exposed through a rear window of the hot cell to the high energy radiation source.
Figure 13:
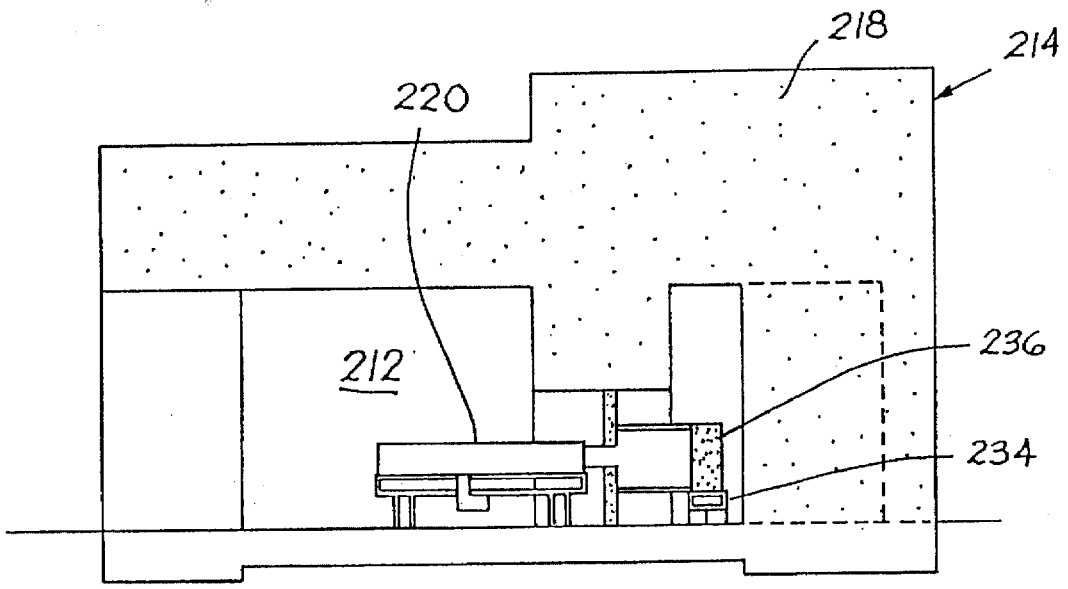
FIG. 13 is a side view of the embodiment showed in FIG. 11.

Still another embodiment is depicted in the view of FIGS. 12 and 13. In this embodiment, the hot cell 212 may contain, for example, a high energy emitting source 220. A conveyor belt 234 housed in a tunnel 235, the walls of which are constructed of material identical to the hot cell 212 and exterior perimeter structure 214. Tunnel 235 extends through the sand 218 in a serpentine configuration so that the entrance 238 and exit 240 are removed from the conical focus path 206 of high energy source 220. The emissions of the high energy source 220 are focussed through a window 230 in the rear of hot cell 212 directly into the tunnel 235. Product 236 such as fruit and the like carried by conveyor 234 is exposed to the source in direct line of sight of the source 220 and thus exposed to the emissions of the source when moving past the window 230 thereby being irradiated and minimizing bacterial growth and spoilage. The serpentine configuration of the tunnel 235 removes the exit and entry of the tunnel from the source minimizing emissions at these locations.

To accommodate the conical emission path 206 of source 220, outer structure 214 is provided with an extension 208 thereby increasing the amount of sand 218 in the path 206 thereby ensuring the MPD level requirement is met as before. Similarly, a barrier 222, such as a sliding metal door, is provided at the entrance to the cell 212 to attenuate the emissions in this direction. While the tunnel 235 is illustrated as being housed entirely exterior to the hot cell 212, it should be understood that the tunnel 235 could extend through the hot cell itself obviating the need for a window 230 with accommodations being made for the openings into the cell with respect to emissions.

From the foregoing, it may be seen that the high energy radiation emitting shielding structures as described above readily meet the objectives as set forth herein. The structures, easily erected and removed, form a substantially sand filled enclosure about the high energy source that extends out from the high energy radiating source greater than the MPD Distance for that source in most directions. Where the MPD distance through the sand is greater than the distance to the exterior perimeter of the structure, energy attenuating barriers are placed within the exterior perimeter across lines extending from the source to those points, thus attenuating the energy emitted sufficiently to meet the MPD level immediately to the exterior of the perimeter along those directional lines. The structures have walls economically fabricated from light weight frames of rails and abutting panels with wire tie forms securing the facing surfaces of the walls together to provide structural integrity against the pressure of the sand. Additional changes and modifications will become apparent to those with ordinary skill in the art. It is understood that the such changes and modifications should be interpreted within the scope of the inventive concept as expressed herein.

We claim:

1. A temporary shelter defining an interior work cell for housing and shielding a high energy radiation source used to irradiate objects placed within said work cell and having a front side for accessing said radiation source and introducing said objects comprising:

at least one vertically positioned wall substantially enclosing and spaced from said source and defining said work cell about said source, a front opening for the introduction of said objects into said work cell to be irradiated by said radiation source, and a roof;

an outer perimeter structure, including at least one second vertically positioned wall substantially extending around and spaced from said first wall and forming a perimeter about said front opening, said first and second walls forming an interior space therebetween, said first wall being lower in height than said second wall, energy attenuating structure extending across said front opening and abutting said second wall, said energy attenuating structure including a removable portion for providing access through said opening into said work cell and to said high energy source, said first and second walls including a frame structure of vertically and horizontally disposed rails and a plurality of abutting panels horizontally positioned against an interior side formed by said rails, said rails of said first and second walls being supported in said vertical positions by a footing so as to maintain said first and second walls in said vertical positions, said first and second walls being connected by support wire from ties extending horizontally with said interior space thereby providing structural integrity against pressure being exerted inwardly on said first wall and outwardly on said second wall, a plurality of sand positioned with the outer perimeter, filling said interior space and covering said roof of said cell wherein said second wall is spaced from said first wall a distance sufficient for said sand to attenuate the measurable energy level at a majority of points immediately exterior to said second wall to less than the maximum acceptable dosage level for said high energy source and said energy attenuating structure attenuates the measurable energy emanating across the front opening at all points along said second wall to less than the maximum acceptable dosage level immediately exterior to said front opening and said second wall.

2. The shelter of claim 1 wherein said second wall includes a front wall, said front wall abutting said first wall about the perimeter of said opening.

3. The shelter of claim 1 wherein said cell is defined by a pair of lateral side walls and a rear wall, said cell further including support members supporting said roof, said roof abutting said lateral and rear sides thereby enclosing a top of said cell;

wherein said outer structure is defined by a front wall and a pair of lateral sides and a rear side spaced predetermined distances from respective lateral and rear sides of said cell thereby forming said interior space therebetween, said front wall of said structure being substantially co-extensive to said front opening of said cell; and wherein said plurality of substantially horizontal disposed support wire form ties extend across said interior space and are attached at the ends thereof to interior surfaces of said second walls and a second number attached at one ends thereof to said interior surfaces and at the other ends thereof to exterior surfaces of said first walls.

4. The shelter of claim 3 in which the rails are steel components and the panels are sheets of plyboard.

5. The shelter of claim 4 including vertical support members positioned at junctures of said first walls, said roof being comprised of horizontally disposed support members extending between and connected to said vertically disposed members, said roof being comprised of a plurality of abutting sand supporting members supported by said horizontally disposed support members.

6. The shelter of claim 3 in which removable portion includes a pivoting door.

7. The shelter of claim 3 in which said removable portion includes a sliding door.

8. The shelter of claim 3 in which said shelter further includes a trailer with an interior space being removably positioned through said opening into said shelter and forming a part of said work cell and housing said high energy source and said access means wherein said attenuating means is positioned co-extensively along said opening in said front wall of said cell when said trailer is portioned with said cell.

9. The shelter of claim 8 in which said shelter has telescopic side walls thereby providing increased working area with said trailer when in position with said shelter.

10. The shelter of claim 1 in which said shelter further includes support structure defining an enclosed serpentine passageway that extends through said sand between first exterior and second exterior openings defined by said second wall and passes a rear section of said first wall, said rear section defining an opening communicating with said passageway, said high energy source being located near said rear section opening, and a conveyor belt positioned in said serpentine passageway to convey products from said first opening past said rear section opening to said second opening thereby exposing the products being moved by said conveyor belt to said high energy source.

11. The shelter of claim 10 in which said high energy source is a source of microwave, radioactive or accelerated atomic particle energy.

12. A method of fabricating a shelter with a working cell in which a source of high energy radiation emissions and objects to be irradiated by said source are housed comprising the steps of determining a locus of points at a distance through the sand of a MPD Distance from the source and fixing a position at which the source is to be located;

erecting a substantially a substantially horizontally disposed and open top first frame structure of frame grids and abutting panels so that the first structure is located at distances from the source greater than the locus of points at a majority of points along a perimeter defined by the first structure;

erecting within the perimeter of and spaced from the first structure a substantially enclosed second structure defining said work cell for housing said source and into which objects can be introduced and irradiated by said source, the first structure having a top and a front opening co-extensive with the first opening, said second structure having a horizontal height less than said first structure;

placing radiation diminishing structures along the front opening of the second structure and adjacent the second structure in a line of sight between the position of the source and points at the outer perimeter structure is closer to the source than the MPD Distance, said radiation diminishing objects having radiation attenuating characteristics sufficient to attenuate high energy radiation emissions to the MPD immediately exterior to the radiation diminishing objects placed along the opening and immediately exterior to the second structure at the points at which the outer perimeter structure is closer than the MPD Distance;

stringing and attaching wire ties between interior surfaces of the first structure and the exterior surfaces of the second structure; and filling an interior spaced formed between said first and second structures with sand to a level above the top of the second structure, said sand having sufficient thickness to substantially attenuate emissions across the thickness of the sand to the MPD wherein said first and second structures and said wire form ties collectively have sufficient strength to with stand pressure exerted by the sand against the respective interior and exterior surfaces of the first and second structures.

13. A structure for housing and shielding a high energy radiation emitting source comprising:

a first wall defining a working cell substantially enclosing and housing said source, said working cell having a front opening providing access into said cell to said source and a roof;

a second wall substantially enclosing and spaced from said first wall, said first and second walls forming an interior space therebetween with an open top, said second wall having a greater height than said first wall, a movable high energy radiation attenuating structure positioned across said opening to provide access to said source through said opening, said first and second walls including a frame structure of vertically and horizontally disposed rails and a plurality of abutting panels horizontally positioned against an interior side formed by said rails, said rails of said first and second walls each having a footing to support said first walls in said vertical positions, said first and second walls further being connected by support wire form ties extending horizontally within said interior space thereby providing structural integrity against pressure being exerted inwardly on said first wall and outwardly on said second wall, a predetermined quantity of sand filling said interior space and covering said roof, said sand having sufficient thickness to attenuate energy emanating from said source to a level not exceeding the maximum permissible dosage at points adjacent to an exterior surface of said second wall;

a tunnel positioned in said sand and defining a serpentine path therethrough, said first wall having an opening in direct line of sight between said source and a predetermined position within said tunnel; and a conveyor belt positioned in said tunnel for carrying product to said predetermined position thereby exposing the product to emissions from said source along said direct line of sight.

14. The structure of claim 13 in which said first structure has at least one first wall and said second structure has at least one second wall substantially extending around said first wall and forming a perimeter about said front opening, said first and second walls forming said interior space therebetween, said first wall being lower in height than said second wall;

said first and second walls including a frame structure of vertically and horizontally disposed rails and a plurality of abutting panels horizontally positioned against an interior side formed by said rails, said first and second walls further being connected by support wire form ties extending horizontally within said interior space thereby providing structural integrity against pressure being exerted inwardly on said first wall and outwardly on said second wall by said sand; and said second wall being spaced from said first wall a distance sufficient for said sand to attenuate the measurable energy level at a majority of points immediately exterior to said second wall to less than the maximum acceptable dosage level for said high energy source and said energy attenuating structure attenuates the measurable energy emanating across the front opening and at all other points along said second wall to less than the maximum acceptable dosage level immediately exterior to said front opening and said second wall.

* * * * *